United States Patent [19]

Takahashi et al.

[11] 4,050,879

[45] Sept. 27, 1977

[54] FUEL COMBUSTION APPARATUS

[75] Inventors: Yasuro Takahashi; Yukihisa Fujima; Masaharu Oguri; Akito Komori, all of Nagasaki, Japan

[73] Assignee: Mitsubishi Jukogyo Kabushiki Kaisha, Tokyo, Japan

[21] Appl. No.: 628,427

[22] Filed: Nov. 3, 1975

[30] Foreign Application Priority Data

Nov. 18, 1974 Japan ..... 49-132501
Nov. 18, 1974 Japan ..... 49-138610

[51] Int. Cl.[2] ..... F23D 15/00

[52] U.S. Cl. ..... 431/174; 431/175; 431/183; 431/186

[58] Field of Search ..... 431/175, 174, 177, 186, 431/182–185, 187–189, 284, 285; 239/424, 424.5

[56] References Cited

U.S. PATENT DOCUMENTS

| | | | |
|---|---|---|---|
| 3,180,395 | 4/1965 | Reed | 431/175 |
| 3,349,826 | 10/1967 | Poole et al. | 431/183 |
| 3,671,172 | 6/1972 | Chedaille et al. | 431/182 X |
| 3,723,049 | 3/1973 | Juricek | 431/183 |
| 3,765,824 | 10/1973 | Trozzi | 431/188 |
| 3,834,858 | 9/1974 | Krippene et al. | 431/175 X |

*Primary Examiner*—Robert G. Nilson

[57] ABSTRACT

A fuel combustion apparatus for burning a premix of an air stream and a fuel jet, comprising an air nozzle for issuing air to form a conically spread film of the air stream, and an atomizer for injecting fuel circumferentially unevenly into the conical film of air stream so that a premix uniformly mixed with air but having a circumferentially varied air-fuel ratio which is locally selectively greater than 1 or less than 1.

5 Claims, 13 Drawing Figures

FUEL COMBUSTION APPARATUS

This invention relates to a fuel combustion apparatus for use with various boilers, furnaces, gas turbines and the like, and more specifically to such an apparatus capable of reducing the production of nitrogen oxides on combustion of fuel.

Conventional prior art combustors for such uses include burners of the construction typically represented in FIGS. 1 and 2. As shown, the air register of the burner comprises an air tube 5, a flange 6, swirl vanes 10, and a swirler 8. The register is accommodated in a wind box 14 defined between the furnace wall 1 and a front plate 13. The furnace wall 1 has a suitably shaped hole 2 to which one end of the air tube 5 is connected, the other end of the tube being provided with the flange 6. The plurality of swirl vanes 10 are secured to the flange 6. The swirler 8 is mounted on the inner end portion of a fuel supply tube 9′ and is disposed in the center of the hole 2. An atomizer 9, composed of the fuel supply tube 9′ and an atomizer head 9″, is held by the front plate 13. The atomizer 9 is aligned to the center axis of the register. FIG. 2 is a view taken along the line II—II of FIG. 1.

As will be seen from FIG. 1, combustion air 12 in the wind box 14 is swirlingly forced into the register as the swirl vanes 10 turn. Most of the air stream thus formed, indicated at 21, passes between the hole 2 and the swirler 8 and is diffused in a conical pattern into the furnace 25. The rest, or part of the incoming air stream designated 20, is imparted with a more intense swirl by the swirler 8 than by the vanes 10, supplied around the atomizer head 9″, and then merged with the main air stream 21. Fuel is fed through the fuel supply tube 9′ to the atomizer head 9″, from which it is injected in a conical pattern. The jet of fuel 22 flaringly spreads into contact with the surrounding air stream 21, forming an air-fuel mixture layer 23 in between for subsequent combustion in the furnace 25.

With the combustion apparatus of the construction described the formation of nitrogen oxides (hereinafter called NOx for simplicity) is a problem. It is well known that the formation of NOx depends largely on the flame temperature involved. If the atmosphere inside such apparatus has a low oxygen concentration, the NOx production will be accordingly small. Also, if the formation of NOx in flame is to be reduced, it is necessary to lower the flame temperature substantially. The flame temperature drop, however, can produce too long flames or result in poor combustibility due to excessive formation of unburned matter.

FIG. 3 is a graph showing the relation between oxygen concentration and flame temperature distribution across the section taken along the line III—III of FIG. 1. The graph indicates the zone in which NOx are formed. As shown, the oxygen concentration in the air layer 21 is adequately high, but it begins to drop in the combustion layer 23 until it is practically reduced to zero in the depth of the latter layer. On the other hand, the temperature is the highest in the region of sufficient oxygen consumption and much heat development. NOx are produced in the neighborhood of the region, or in the zone indicated at A, where an adequate supply of oxygen is consumed and the temperature is high.

Thus, in the conventional combustion apparatus, air and fuel are separately introduced into the furnace and are burned while being mixed therein, thereby obstructing any tendency for reducing the NOx production.

It is a fundamental object of the present invention to provide a burner which maintains good combustion and controls the formation of NOx by keeping the oxygen concentration at a low level and eliminating the region of high flame temperature.

A further object of the invention is to provide a combustion apparatus which forms an air stream in the form of a conical film, and injects fuel from an atomizer in such a manner that the air ratio in the air stream is locally greater than 1 and in the rest less than 1, thus forming a premix and hence a premix flame so as to produce less NOx than in the conventional equipment.

Other objects and advantages of the invention will become more apparent from the following description taken in conjunction with the accompanying drawings showing embodiments thereof. In the drawings.

Figure 1:
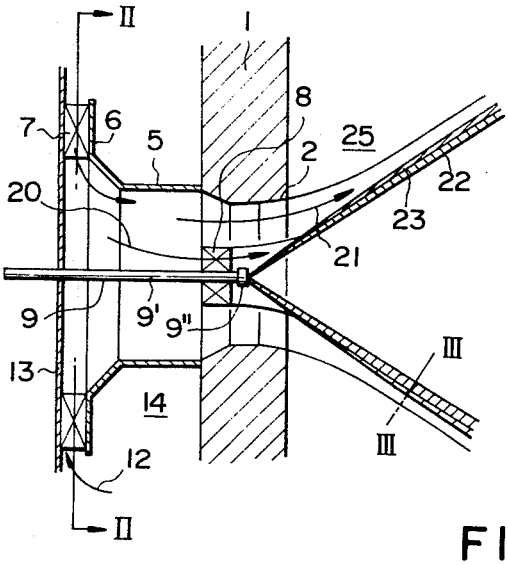
FIG. 1 PRIOR ART
Figure 2:
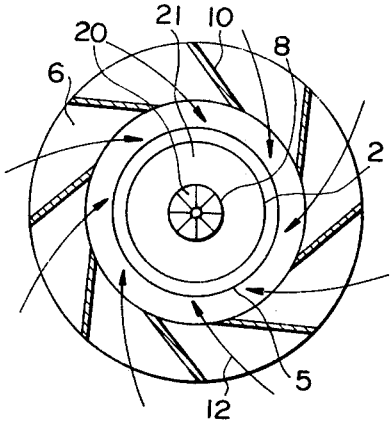
FIG. 2 PRIOR ART

Throughout these views like and similar parts are given like numbers with respect to FIGS. 1 and 2 showing a conventional apparatus, and their description will be omitted hereinafter.

Figure 4:
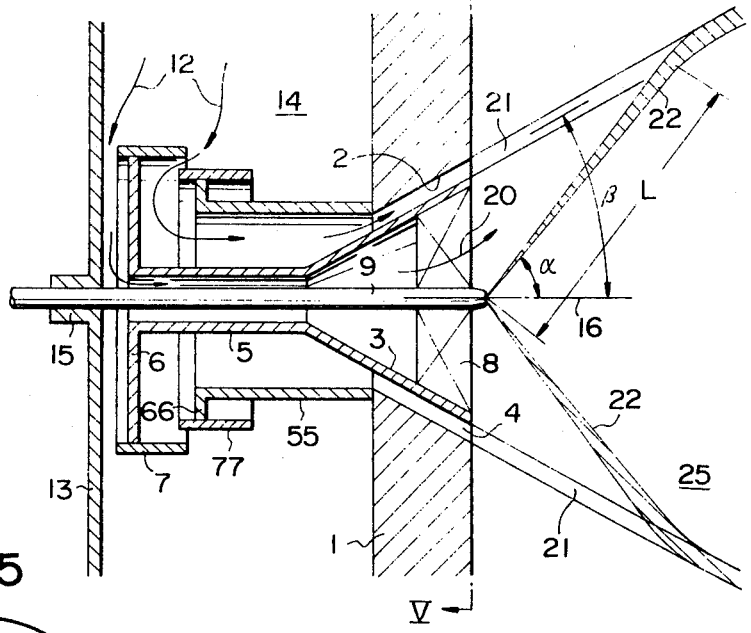
FIG. 4 is a vertical sectional view of a fuel combustion apparatus as a first embodiment of the invention.
Figure 5:
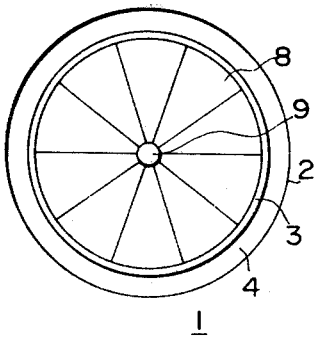
FIG. 5 is a sectional view taken along the line V—V of FIG. 4 and as seen in the direction of the arrows.

Referring now to FIGS. 4 and 5 illustrating the first embodiment of the invention, a furnace wall 1 has a through hole 2 which defines, between its surrounding wall and a cone or conical nozzle 3 inserted into the hole, a thin (preferably not more than 100 mm-thick) annular, conical air passage 4. To the smaller end of the cone 3 is connected a primary-air tube 5, the other end of the tube being formed with a flange 6, which in turn is surrounded by a primary-air regulating gate 7. Similarly, a secondary-air tube 55, connected at one end to the edge of the hole 2, is provided with a flange 66 and a secondary-air regulating gate 77 therearound. An atomizer 9 is secured at the inner end to the inner wall of the cone 3 via a swirler 8, and the rear portion of the atomizer is slidably supported by a plain bearing seat 15 attached to a front plate 13. The atomizer 9 is located in the center of the air register.

The fuel-injecting tip of the atomizer 9 is set to an angle such that the angle of deviation, $\alpha$, of the resulting jet of fuel 22 from the burner axis 16 will be larger than the angle of deviation, $\beta$, of the air stream 21 from the burner axis 16. In addition, the tip angle is so set as to allow the jet of fuel 22 from the atomizer head to travel a certain distance L before it comes in contact with the surrounding air stream 21 within the furnace 25. For the setting the distance L is preferably not less than 0.5 m.

Fuel is injected in the form of a conical spray, but the air fuel ratio of the resulting premix is deliberately varied circumferentially. For this purpose, the plurality of orifices of the atomizer is designed to have such cross sectional areas and density that will provide varied ratios; for example, in the right half of the premix as viewed in FIG. 5 the air-fuel ratio is less than 1 and in the left half the ratio is much greater than 1.

The operation of the fuel combustion apparatus according to the invention will now be described.

Part of combustion air 12 from the wind box 14 passes between the front plate 13 and the flange 6 and thence through the passage between the primary-air tube 5 and the atomizer 9, and is caused to swirl by the swirler 8, and then is supplied as a primary-air stream 20 to the furnace 25. The air supply is controlled, for example, by moving the primary-air regulating gate 7 toward or away from the front plate 13.

The rest of combustion air 12 from the wind box 14 flows between the flanges 6 and 66 and thence through the passage between the primary- and secondary-air tubes 5, 55 and is finally supplied as a secondary-air stream 21 to the furnace 25 via the conical air passage 4. This air supply too is controlled, for example, by moving the secondary-air regulating gate 77 toward or away from the flange 6.

The width of the air passage 4, transversely of wall 1, can be adjusted by moving cone 3, to which the atomizer 9 is secured axially forward or backward.

Since fuel is sprayed conically from the atomizer 9, the jet of fuel 22, even in liquid form, will be heated and vaporized as it passes through the hot combustion gas layer before reaching the air stream 21. The vaporized fuel then mixes with air and burns together as a premix which is locally uniformly mixed but which varies in air-fuel ratio between left and right halves of the burner.

In the combustion of the premix, the fuel does not burn up in the premix portion where the air ratio is less than 1. The unburned fuel burns gradually downstream with air at a ratio greater than 1 and finally burns completely.

In contrast to the prior art combustion equipment wherein combustion is carried out by mixing the air stream 21 and the jet of fuel 22 in a not always satisfactorily uniform manner, the apparatus of the invention supplies the air stream 21 from the air passage 4, to the furnace 25, in the form of a relatively narrow annulus, thus making it possible to mix the air stream more uniformly with the jet of fuel 22.

In the combustion within the prior art apparatus, there always exists a zone in the mixture layer 23 where the temperature is high and the oxygen concentration is low. In the apparatus of the invention, by contrast, an air-fuel mixture is provided which is locally homogeneous but is generally varied in air-fuel ratio, the air supply being sufficiently larger there and smaller here than the amount of theoretical air to prevent the formation of the high-temperature low-oxygen region that usually exists in the conventional equipment. Thus, because there is no high-temperature low-oxygen region which ordinarily gives birth to much NOx, the NOx production is limited to a very low level.

The amount of air to meet the entire requirement of the burner may be somewhat larger than the theoretical amount, so that the blower power and exhaust losses can be kept at low levels as with the conventional apparatus.

Combustibility is good because the combustion is preceded by premixing.

Figure 3:
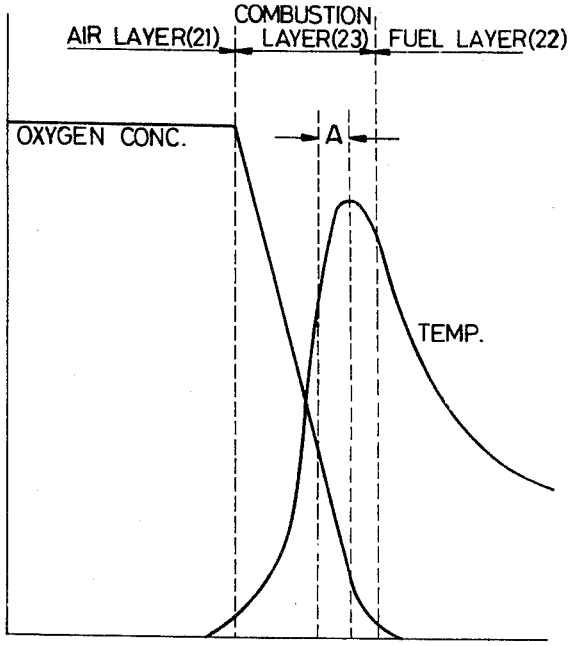
Figure 6:
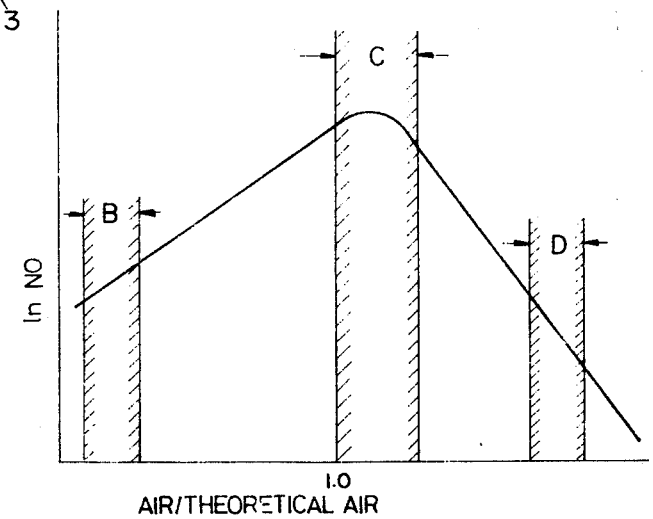
FIG. 6 is a characteristic curve of NOx production in a premix flame.
Figure 7:
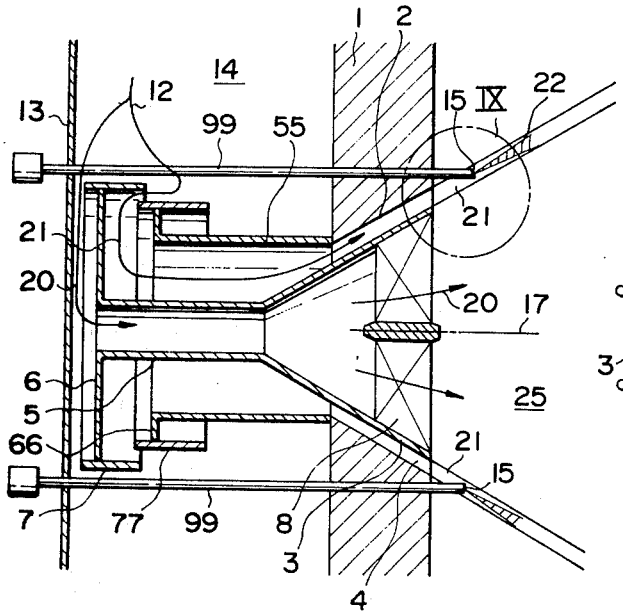
FIG. 7 is a vertical sectional view of a second embodiment of the combustion apparatus of the invention.
Figure 8:
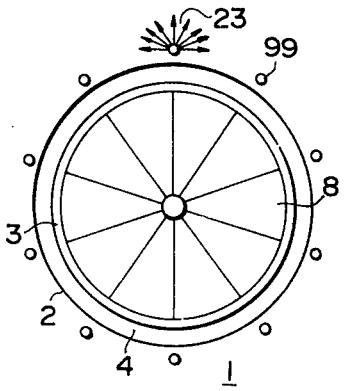
FIG. 8 is a front view of the apparatus shown in FIG. 7.
Figure 9:
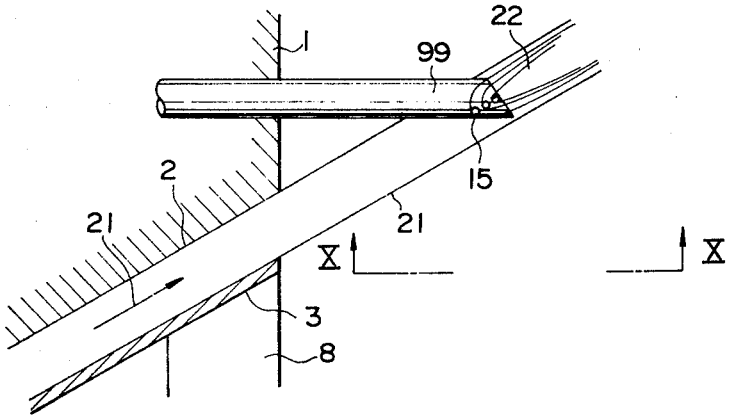
FIG. 9 is an enlarged view of the encircled portion IX of FIG. 7.
Figure 10:
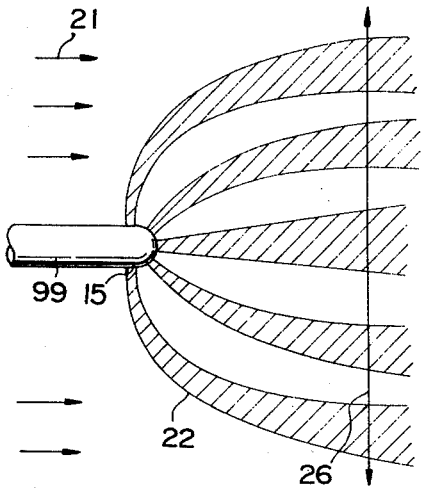
FIG. 10 is a sectional view taken along the line X—X of FIG. 9 and as viewed in the direction of the arrows.
Figure 11:
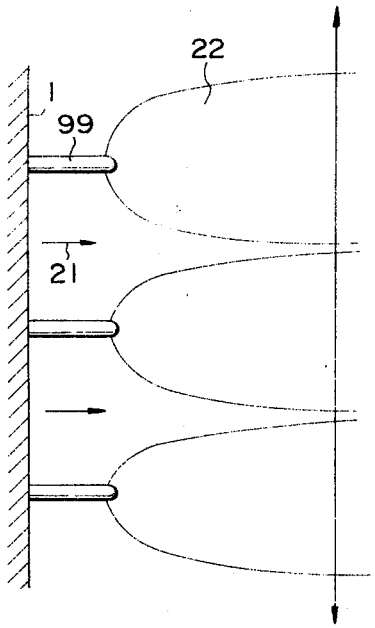
FIG. 11 is a development of a column centering around the axis of the burner shown in FIG. 7.

The parallel combustion of the rich and lean premixes renders it possible to keep the NOx production at a very low level despite the fact that the overall air amount is approximately equal to the theoretical amount. This will be discussed in further detail below with reference to FIG. 6 showing a characteristic curve of NOx production in premix flame. As the curve in the figure indicates, the NOx production is high with the air supply near the theoretical level and drops sharply with an increase or decrease of the air amount. While the air-fuel mixture layer 23 in a conventional apparatus (FIG. 1) does always have a zone corresponding to the zone C in FIG. 6 (also corresponding to the zone A in FIG. 3), the zone is eliminated and replaced by zones B and D in the apparatus of the invention. As can be seen from the graph in FIG. 6, the zones B and D are distant from the zone where the NOx production is the highest, and therefore the NOx production can be minimized.

The formation of NOx in the premix flame being highly dependent on temperature, it can be confined within a very low range by the introduction of recycling gas.

The apparatus according to the invention proves particularly useful also when employed for the combustion of liquid fuel with low volatility.

Next, the second embodiment of the invention illustrated in FIGS. 7 through 11 will be described. As shown, a furnace wall 1 has a through hole 2 which defines, between its surrounding wall and a cone 3 inserted into the hole, a thin (preferably not more than 100 mm-thick) annular, conical air passage 4. To the smaller end of the cone 3 is connected one end of a primary-air tube 5, the other end of the tube being connected to a flange 6. The flange 6, in turn, is surrounded by a primary-air regulating gate 7. A secondary-air tube 55, connected at one end to the edge of the hole 2, is provided with a flange 66 and a secondary-air regulating gate 77 therearound. A swirler 8 is located in the cone 3. Around the outlet end of the air passage 4 there are installed a plurality of atomizers 99, with the fuel-injecting orifices 15 at their tips being open in the centers of imaginatory extensions of the air passage 4. The cross sectional areas and/or number of orifices are chosen so that the plurality of atomizers 99 which provide air ratios much great than 1 and less than 1 are alternately arranged.

The operation of the second embodiment of the combustion apparatus according to the invention is as follows.

Part of combustion air 12 from the wind box 14 is allowed to proceed between the flange 6 and the front plate 13 and through the primary-air tube 5, imparted with a swirl by the swirler 8, and then is supplied as a primary-air stream 20 to the furnace 25. The air supply is controlled, for example, by moving the primary-air regulating gate 7 toward or away from the front gate 13.

The rest of combustion air 12 from the wind box 14 passes between the flanges 6 and 66 and through the passage between the primary- and secondary-air tubes 5, 55, and then is supplied as a secondary-air stream 21 through the conical air passage 4 to the furnace 25. The amount of this air stream 21 is controlled, for example, by moving the secondary-air regulating door 77 toward or away from the flange 6.

The width of the air passage 4 can be adjusted by moving the cone 3 axially forward and backward.

Fuel is injected from the atomizers 99 and, in the form of jets of fuel 22, blown into the air stream 21 from the air passage 4. The flow patterns of fuel jets 22 from the orifices 15 and the air stream 21 from the air passage 4 will be described in detail below with reference to FIGS. 9 to 11.

Each of the atomizers 99 has a plurality of orifices along the plane of its head tangential to the path of the air stream 21. The individual orifices have a funnel-shaped enlargement at the outer end. (FIGS. 9 and 10) The fuel jets 22 are deflected by the air stream 21 and are uniformly distributed in the direction 26 at right angles to the air stream 21. In this way fuel is mixed rapidly and thoroughly with air for combustion.

In the combustion space, the fuel will not burn completely in the region where the air ratio of the premix formed by the fuel jets 22 from the atomizers 99 with the air stream 21 through diffusive contact is less than 1. However, the unburned fuel is gradually burned downstream with excess air in the adjacent region where the air ratio of the premix is greater than 1, and is eventually burned completely.

While the prior art combustion equipment mixes the air stream 21 and jets of fuel for combustion through contact, the apparatus of the invention supplies the air stream 21 from the air passage 4, narrowed in width, to the furnace 25, thus making it possible to mix the air stream uniformly with the jets of fuel 22.

In the combustion within the conventional apparatus, there always exists a zone in the mixture layer 23 where the temperature is high and the oxygen concentration is low. In the apparatus of the invention, by contrast, an air-fuel mixture is provided which is locally uniform in mixing ratio but is generally varied in air ratio, the air supply being sufficiently larger or smaller across different sections than the amount of theoretical air to prevent the formation of the high-temperature low-oxygen region common to the existing equipment. Thus, because there is no high-temperature low-oxygen region which would otherwise give birth to much NOx, the NOx production is reduced to a very low level.

The amount of air to meet the entire requirement of the burner may be somewhat larger than the theoretical amount, so that the blower power and exhaust losses can be kept at low levels as with the conventional apparatus.

Combustibility is good because the combustion is preceded by premixing.

For the reason already explained in connection with FIG. 6, the parallel combustion of the rich and lean premixes renders it possible to keep the NOx production at a very low level despite the fact that the overall air amount is equal to the theoretical value.

Figure 12:
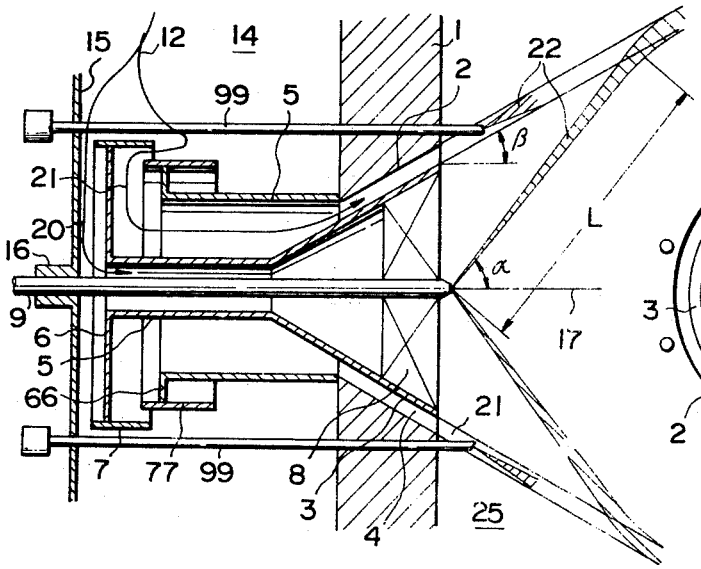
FIG. 12 is a vertical sectional view of a third embodiment of the combustion apparatus of the invention.
Figure 13:
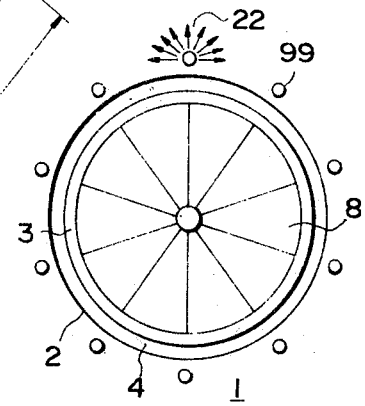
FIG. 13 is a front view of the apparatus shown in FIG. 12.

Now, the third embodiment of the invention will be described specifically with reference to FIG. 12 which is a vertical section and FIG. 13 a front view of the apparatus.

The third embodiment is a modification of the second one with an additional atomizer 9 in the center. The atomizer is located on the axis 17 of the burner assembly and secured at one end to the cone 3 via the swirler 8. The other end of the atomizer is slidably supported by a bearing seat 16 attached to the front plate 13.

The fuel-injecting tip of the atomizer 9 is set to an angle such that the angle of deviation, $\alpha$, of the resulting jet of fuel 22 from the burner axis 17 will be larger than the angle of deviation, $\beta$, of the air stream 21 from the burner axis 17. In addition, the tip angle is so set as to allow the jet of fuel 22 from the atomizer head to travel a certain distance L, which is preferably 0.5 m or more, before it comes in contact with the surrounding air stream 21 within the furnace 25.

The cross sectional areas and/or density of the atomizer orifices are chosen to vary the air ratio of the mixture circumferentially although fuel is sprayed in an annular, conical pattern. Also, the atomizers 99 arranged in a circle are designed to vary the amount of fuel injection, for example, between the right five and left five of the atomizers 99 (ten in total) shown in FIG. 13.

The third embodiment operates in the following way.

When fuel is gaseous or liquid with high volatility, fuel is injected from the plurality of atomizers 99 into the air stream 21, so that the fuel and air are mixed through contact at the outlet of the burner. In case of a liquid fuel, the liquid drops uniformly dispersed in air are vaporized by the heat from the hot atmosphere in the furnace 25, the vapor forming a gaseous premix with air.

If the fuel is less votatile liquid, it is injected from the atomizer 9 located distant from the outlet of the air passage 4. Sprayed and flown through the hot combustion atmosphere before it mixes with air, the fuel is heated and vaporized. The vaporized fuel and air are mixed, and the premix thus formed is fed to the furnace 25.

With this embodiment rich and lean mixtures are concurrently formed in the same manner as described with respect to the second embodiment, with the exception that this modification can burn liquid fuel of low volatility as well.

While the present invention has been described in its preferred embodiments, it is to be understood that the invention is not limited thereto but various modifications may be made without departing from the spirit and scope of the invention.

What is claimed is:

1. A fuel combustion apparatus for burning a premix of air and fuel, comprising a conical air nozzle positioned in spaced relation within a conical opening in a furnace wall to define an air passageway therebetween to form a conical film of air and fuel atomizing means for injecting fuel into the conical film of air in amounts varying circumferentially of said film of air so that a premix is formed uniformly mixed with air and having a varied air-fuel ratio which is greater than 1 and less than 1 at predetermined circumferential locations of said film of air.

2. An apparatus according to claim 1, wherein atomizer means is disposed concentrically within said conical air nozzle remote from the air passageway and is adapted to direct a stream of fuel angularly outwardly so as to impinge with the conical film of air so that the conical film of air and the fuel from the atomizer means are mixed together at a location spaced from fuel-injecting orifices of the atomizer means, said atomizer means having a plurality of fuel-injecting orifices varying in cross-sectional area.

3. An apparatus according to claim 1 wherein a plurality of atomizers are disposed circumferentially of the conical film of air.

4. An apparatus according to claim 3 wherein an additional atomizer means is disposed concentrically within said conical air nozzle remote from said air passageway and is adapted to direct a stream of fuel angularly outwardly so as to impinge with the conical film of air so that the conical film of air and the fuel from the additional atomizer are mixed together at a location downstream of said plurality of atomizers.

5. An apparatus according to claim 1 wherein said conical air nozzle is shiftable axially within the opening in the furnace wall and relative to the said atomizer means.

* * * * *